United States Patent [19]

Barclay

[11] Patent Number: 4,607,800

[45] Date of Patent: Aug. 26, 1986

[54] SOLID WASTE COMMINUTION MACHINE

[76] Inventor: Randel L. Barclay, 5616 Carpenter Rd., Stockton, Calif. 95205

[21] Appl. No.: 742,650

[22] Filed: Jun. 10, 1985

Related U.S. Application Data

[63] Continuation of Ser. No. 545,071, Oct. 24, 1983, abandoned.

[51] Int. Cl.[4] ..... B02C 7/04

[52] U.S. Cl. ..... 241/159; 241/233; 241/236; 241/DIG. 31

[58] Field of Search ..... 241/152 R, 159, 166, 241/167, 230–236, DIG. 31

[56] References Cited

U.S. PATENT DOCUMENTS

| | | | |
|---|---|---|---|
| 727,177 | 5/1903 | Montgomery | 241/232 |
| 3,099,406 | 7/1963 | Kantz | 241/231 X |
| 3,931,935 | 1/1976 | Holman | 241/24 |
| 4,168,806 | 9/1979 | Jacobs | 241/234 X |
| 4,374,573 | 2/1983 | Rouse et al. | 241/101.7 |

*Primary Examiner*—Mark Rosenbaum
*Assistant Examiner*—Timothy V. Eley
*Attorney, Agent, or Firm*—Thomas Schneck

[57] ABSTRACT

A solid waste comminution machine having two pair of cutting wheels, one above the other. The upper pair is mounted on opposed lever arms which are movable relative to the lower wheel pair such that the upper wheel pair can exert leverage on solid waste between wheel members forcing the solid waste material to be worked by the lower wheel pair. The upper wheel pair has peripheral edges adapted for ripping solid waste material between the two wheels, while the lower wheel pair has smooth, hardened, peripheral edges adapted for shearing material forced against the lower wheel pair. The lever arms are pivoted about shafts supporting the lower wheel pair and the inward ends of the lever arms are connected at a joint so that motion of the lever arms can be synchronized.

12 Claims, 15 Drawing Figures

SOLID WASTE COMMINUTION MACHINE

Description

This is a continuation of co-pending application Ser. No. 545,071, filed on Oct. 24, 1983, now abandoned.

TECHNICAL FIELD

The invention relates to conversion of solid waste materials into small pieces by ripping and shearing.

Background Art

Presently most solid waste in the U.S. is buried in landfills. It is estimated that 150 million tons of solid trash is produced daily in the U.S. Some of this waste could be converted to energy if it could be reduced in size. One of the most troublesome waste products, yet one having a significant energy content, is tires.

In U.S. Pat. No. 3,391,935 Holman discloses paired rotary cutting wheels, one pair of wheels above the other. An upper pair of wheels is disposed to shear material placed in the region where the two wheels come together with the upper pair of wheels meshing into clearances in the lower pair of wheels. Each pair of wheels is actually a set of interleaving wheels. One of the purposes of the second pair of wheels is to remove sheared material from between members of the first pair, since debris tends to accumulate between interleaving wheels. The debris is cleared in preparation for the wheel rotation. The apparatus is especially adapted to shred tires.

In U.S. Pat. No. 4,374,573 Rouse et al. disclose paired rotary cutting wheels wherein the wheel pairs are reversed relative to the Holman patent. This allows the Rouse apparatus to stuff material into the cutting wheels. The upper wheels also clear sheared material between interleaving members in the lower wheels. The upper wheels can also exert intense downward pressure on objects, using adjustable separations of the upper wheels to achieve this. Rouse et al. in FIGS. 8 and 9, together with accompanying text, teach the advantage of allowing the upper pair of wheels to move laterally, driven by hydraulic cylinders, to accommodate objects of different sizes.

While the machines of Holman and Rouse et al. have aroused interest in solid waste comminution, there has not been a large number of machines built to date. One of the problems encountered with machines of the prior art is that forces developed by the upper set of wheels are insufficient to drive all material into the lower set of wheels. Instead, material becomes jammed between the upper and lower sets of wheels. Another problem in machines which would have movable cutting wheels acting as rotary shears is that the wheels are so closely spaced together that slight misalignments from end to end cause wheels which are members of the same movable wheel group to come into contact. Shafts carrying meshing wheels would lose parallel alignment and meshing wheel members would lose operational clearances, causing loss of life expectancy. The number of breakdowns under heavy use discourages use of this technology.

An object of the present invention was to provide a rotary wheel shredding machine, able to handle difficult materials, such as tires, telephone poles and sofas, yet which develops sufficient forces between wheels so that all or virtually all material is accepted yet which maintains alignment of the movable wheels.

DISCLOSURE OF INVENTION

The above objects have been met in a solid waste comminution machine which has two pair of cutting wheels, including an upper pair for ripping and stuffing material into a lower wheel pair, specially adapted for shearing. The upper wheel pair tears and shears material too wide for the lower wheel pair and continues this action until the material can be accepted in the lower wheel pair. The upper pair is movable, supported by opposed lever arms, pivoted on the shaft axes which support the lower pair of wheels. The lever arms serve two principal functions. First, the upper wheels can be pushed, with leverage, against material to be worked against the lower wheel pair. Second, the lever arms provide a moving frame, rigidly supporting the upper wheels, even as they are moved, keeping the upper wheels in alignment. Hydraulic cylinders push the lever arms together, forcing the upper wheels inward, causing the upper wheels to rip and shear any material stalled at the meshing point of the lower wheels. The pressure between the upper wheels can be adjusted as desired. The lever arms may have inward ends connected at joints, such as gears, which synchronize motion of the two arms.

Each pair of wheels is actually a pair of wheel groups, each group having a plurality of wheels on a shaft, interleaving with wheels on another shaft such that shearing action occurs when the wheels rotate. The upper set of wheels has circumferentially exposed knife edges for ripping material coming into contact with the edges. Some shearing also occurs in the upper set. When material fails to proceed through the pinch points of the lower set of wheels, the upper set of wheels will rip and shear the material until it is accepted by the lower set of wheels. The upper wheels, then, function to precut, to feed and to clean out material between interleaving wheels relative to the lower wheels. The lower set of wheels does not have circumferentially exposed knife edges, but rather relies only on shearing action between interleaving wheel groups. The combination of ripping and shearing action provides an ideal manner of reducing the bulk of solid waste.

Each set of wheels features protected non-cutting surfaces, for long machine life, as well as protection beneath cutting surfaces in the event of cutting surface failure. Special wear shoes are provided to afford such protection, yet may be removed if damaged.

BEST MODE FOR CARRYING OUT THE INVENTION

Figure 1:
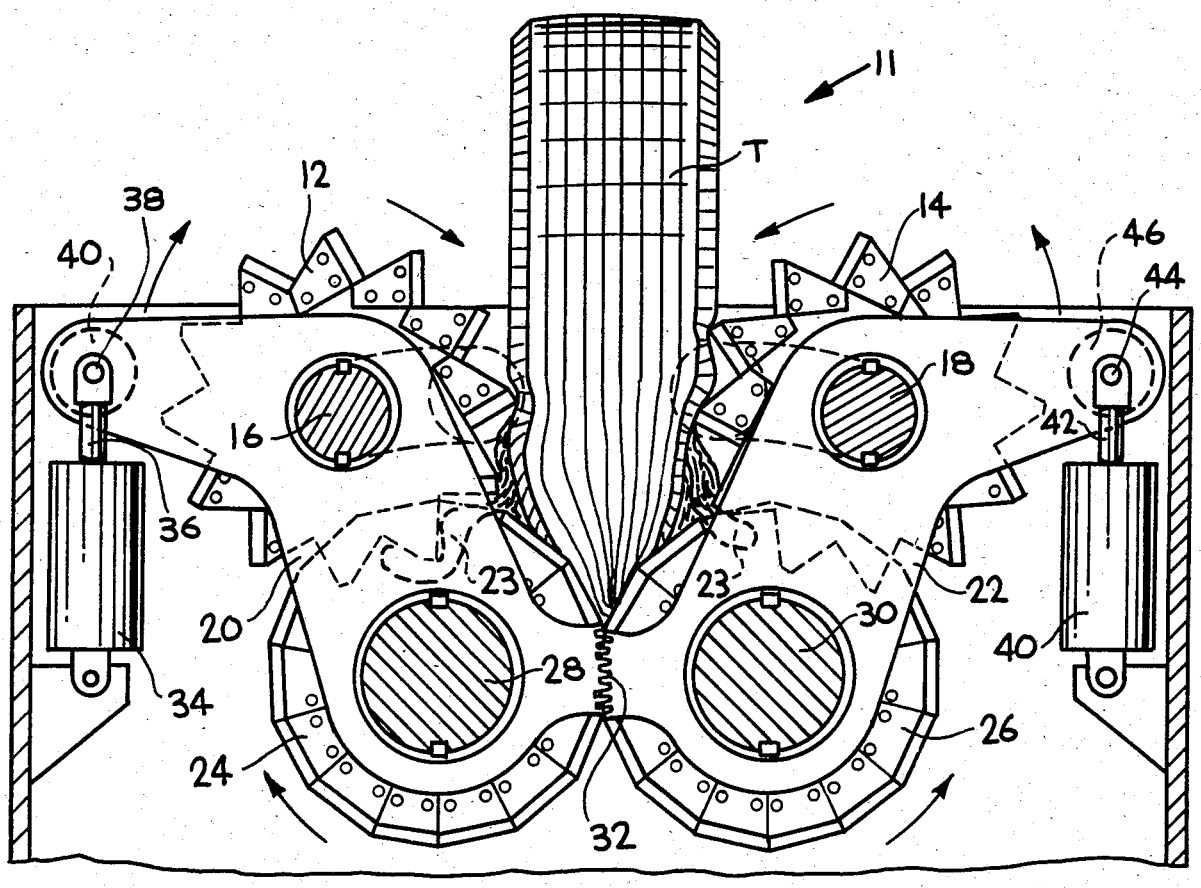
FIG. 1 is a side sectional view of the solid waste comminution machine of the present invention.

With reference to FIG. 1 a solid waste comminution apparatus 11 may be seen. The apparatus features an upper set of wheels 12 and 14 which are seen contacting tire T. Upper wheels 12 and 14 are mounted on shafts 16 and 18 which, in turn, are mounted on lever arms 20 and 22. The shafts 16 and 18 are parallel shafts which are maintained in parallel relation by the lever arms.

A lower set of wheels 24 and 26 are mounted on shafts 28 and 30 respectively. These are fixed, parallel shafts which pass through the lever arms. The axial centers of shafts 28 and 30 form pivot points for lever arms 20 and 22. The inward ends of the lever arms contact each other at a joint 32 which synchronizes motion of the two shafts. The joint is formed by intermeshing gear teeth such that movement of one arm about its pivot point causes a corresponding movement in the opposite direction of the other arm about its pivot point. The outer end of arm 20 is connected to a hydraulic cylinder 34 which includes a piston 36 which pushes a bearing 38 connected to a lengthwise shaft 40, parallel to shaft 16. Shaft 40 is connected to another lever arm on the opposite side of the apparatus. The two opposed lever arms with shaft 40 therebetween maintain alignment of the cutting wheels by providing a box-like framework supporting the wheels. In the same manner, hydraulic cylinder 40, operates piston 42 moving bearing 44 which, in turn, is connected to shaft 46. This shaft connects lever arm 22 to another similar lever arm on the distant side of the apparatus. The shaft 46 serves in function similar to shaft 40, providing rigidity to the upper wheel set, attempting to avoid misalignments when wheel sets 12 and 14, as well as 24 and 36 intermesh.

Figure 2:
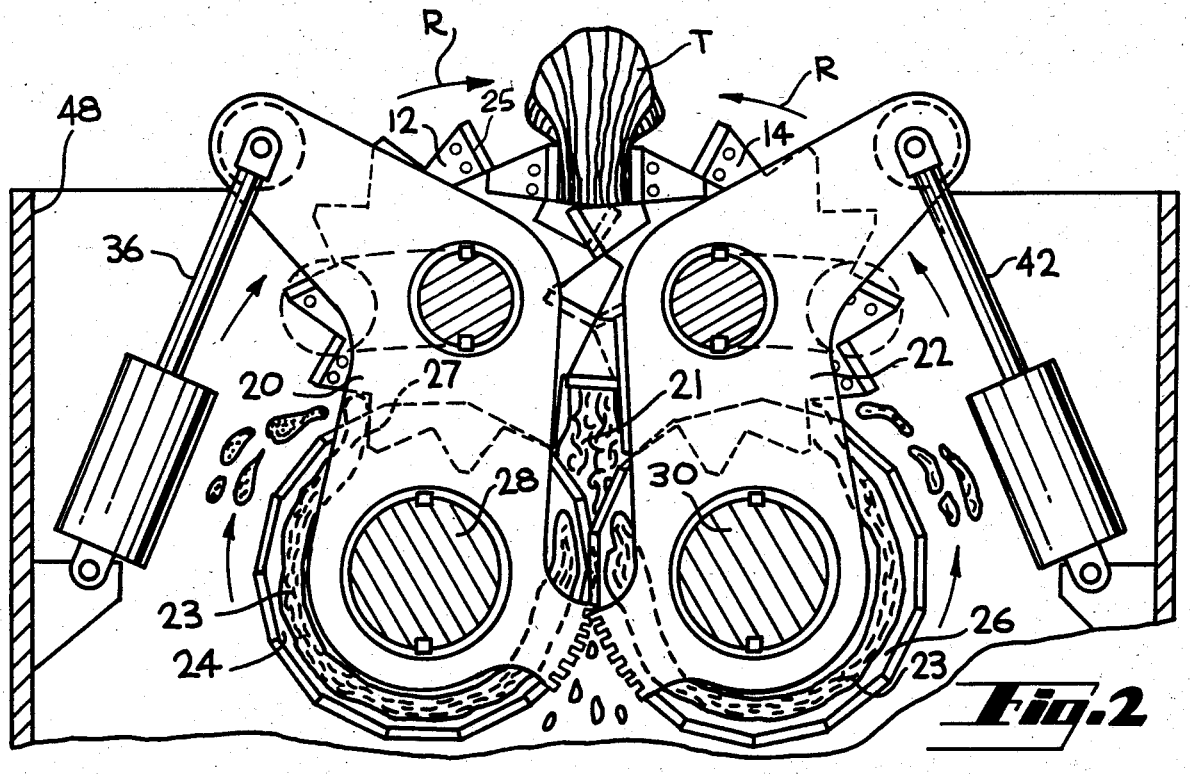
FIG. 2 is another side sectional view of the machine illustrated in FIG. 1 showing inward clamping action of the apparatus.

The upper set of wheels 12 and 14 intermesh between themselves. Similarly, the lower set of wheels 24 and 26 intermesh. Upper and lower sets of wheels 16 and 24, as well as 18 and 26, also intermesh. The full intermeshing relationship of the wheels is illustrated in FIG. 2. With reference to FIG. 2, pistons 36 and 42 are extended bringing arms 20 and 22 together. The position of the upper set of wheels 12 and 14 can mesh temporarily during the piston extension. Wheels 24 and 26 always maintain the same position, in a meshing relationship. The extension of pistons 36 and 42 causes a pivoting of lever arms 20 and 22 about the central axes of shafts 28 and 30. This pivoting action causes wheels 12 and 14 to work more strenuously against tire 15 or other material therebetween. The pivoting action also causes feeding of the material into the wheels 24 and 26.

The clamping action of the upper wheels 12 and 14 causes a ballooning out of solid waste in region 21 between the two wheels. In FIG. 1 some material 23, indicated by dashed lines, is moving into the region between interleaving members of the lower wheel set. In FIG. 2, the material 23 which entered the interleaving wheels is seen to have made a complete circle and is being ejected by the intermeshing of the upper wheels 12 and 14. Thus, the upper set of wheels serves to clean and clear the lower set of wheels. It should be noted that tool 25 on wheel 12 is in a position to encounter tire T and after making approximately two-thirds of a revolution will also be in a position to clear debris 23 at position 27. Similarly, wheel 26 is cleared by the rotation of wheel 14. The direction of rotation of wheels 12 and 14 is indicated by arrows R.

The upper set of wheels, 12 and 14, have outer circumferentially stepped regions, resembling triangles, known as knives. The knives serve a ripping and stuffing function prior to the shearing action of lower wheels 24 and 26. The ripping action of the upper set of wheels is primarily a vertical, lengthwise cutting action, and becomes a shearing action as it meshes with the lower wheels while the shearing action of the lower wheel set 24 and 26 is primarily a transverse or horizontal cutting action. In combination, these two modes of cutting serve to effectively reduce the bulk of solid waste material fed into the cutting wheels. If, instead of a tire or a 55-gallon drum, a telephone pole were fed between the upper wheel set, with the axis of the telephone pole parallel to the axis of the wheel axes, the pole might not be reduced in size if sole reliance were placed on the lower wheels. However, if the pole is resting between the lower wheels and the upper wheels are clamped down upon it the ripping action of the upper wheels would soon create smaller pieces which would pass between the lower wheels. The lower set of wheels 24 and 26 have circumferential regions which are piecewise smooth. The interleaving of these sets of wheels causes shearing, but not ripping action. The entire apparatus may be seen to be housed in a housing 48 which provides protection from flying debris.

Figure 3:
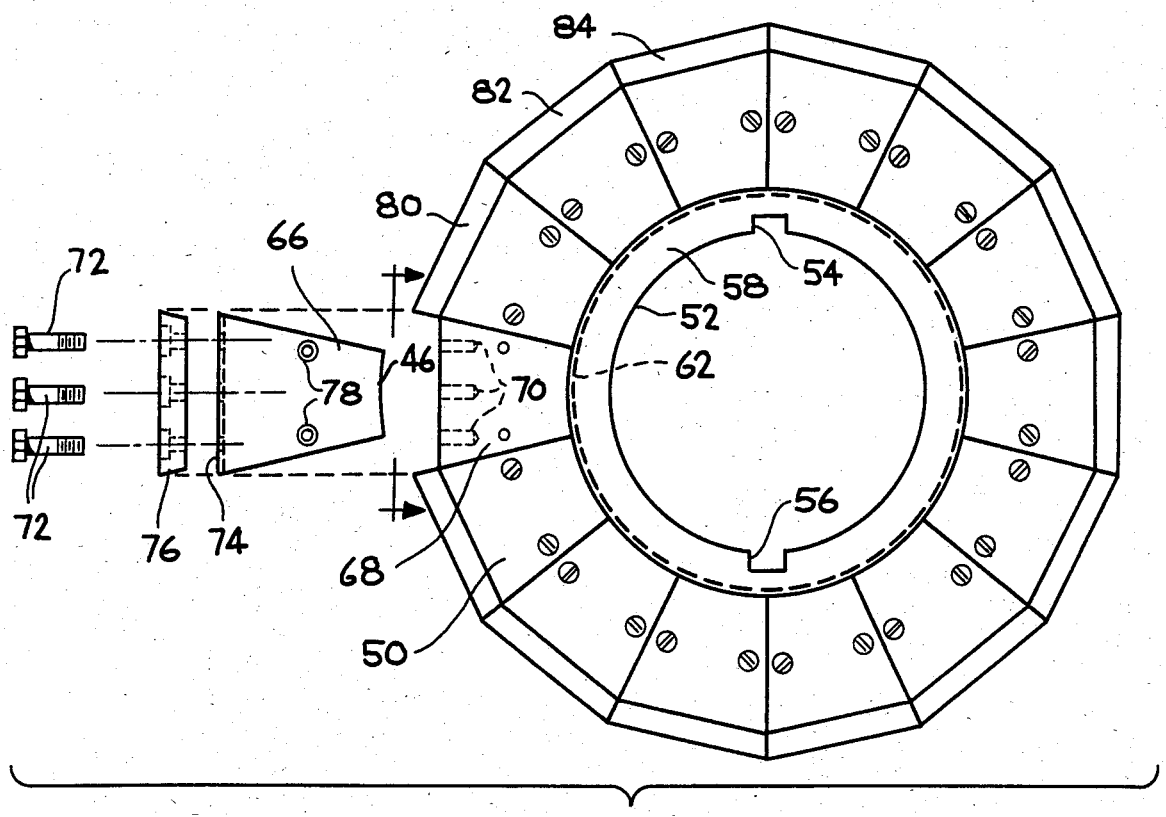
FIG. 3 is a plan view of one of the lower cutting wheels of the machine illustrated in FIG. 1 featuring an exploded view of a cutting tool and its seat.

Construction of a cutting wheel within the lower set of wheels is illustrated in FIG. 3. Wheel 50 has a hollow inside radius 52 with a pair of diametrically opposed slots 54 and 56. These slots are intended to permit passage of keyways therethrough for preventing slippage of the wheels while on the shaft on which the wheels are mounted. The wheel has an inner annular region 58 having lateral annular grooves 62, indicated by dashed lines, serving to support the lower extremity 64 of wear shoe 66. Outward of annular region 58 is the main wheel section 68. The outer circumferential periphery has threaded holes 70 to receive bolts 72. The wheel is made of medium carbon steel, with the annular region 58 having the machined grooves 62 on either side for receiving inward region 64 of the wear shoe 66. The wear shoe, which is case hardened, is intended to protect sides of the wheel 50 from abrasion. Wear shoe 66 has a flat top surface 74 intended to carry a tool 76 made of hardened tool grade steel. Each wearing side of the tool has a strip of tungsten carbide, or high speed steel, approximately $\frac{1}{8}$ inch thick, braised to it. These strips are braised to exposed lateral surfaces of the tool. No strips are braised to the top of the tool since this would cover bolt heads. The tool is held in place on the wear shoe by means of the bolt 72. In turn, the wear shoe 66 is held in place by bolts passing through holes 78. The heads of the bolts passing through these holes are approximately flush with the lateral sides of annular ring 58 which is inward from the bolts. The plurality of tools 80, 82, 84 forms a series of circumferentially piecewise smooth tools which define a polygonal peripheral surface. The smoothness of this surface is in contrast to the discontinuous tool surface of the upper set of wheels. The smoothness of the outer peripheral surface means that wear is principally on the lateral side of each tool as opposed to the top surface of the tool. Most of the wear occurs at tool edges at the point where meshing wheels come together. The large amount of stress on the tools causes even the highest quality tools to break off and require replacement. The position of bolt 72 allows rapid tool changement. Moreover, the case-hardened wear shoe 66 provides protection for the bare wheel, since the bare wheel is a difficult part to change, requiring removal of an entire shaft.

Figure 4:
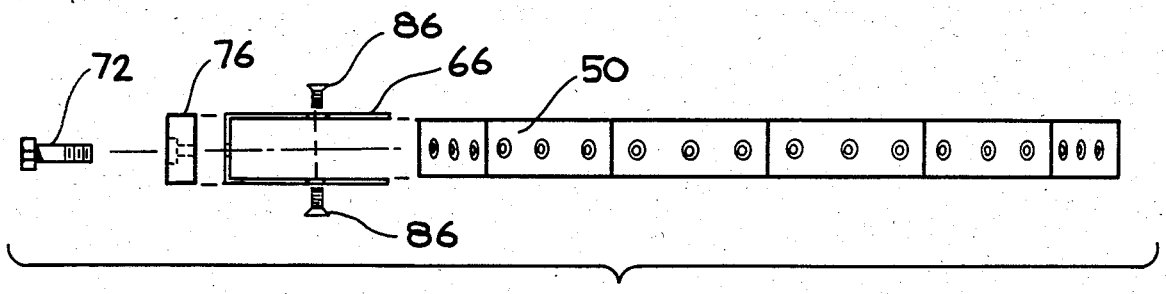
FIG. 4 is a side view of the wheel illustrated in FIG. 3.

In FIG. 4 the U-shaped configuration of wear shoe 66 may be seen. The shoe is held in place by bolts 86 on wheel 50. Tool 76 is seen to rest on a portion of the wear shoe, unlike tools of the prior art which were mounted directly to wheels. It is important to protect the circumferential periphery of a wheel in the event a tool falls off during operation.

Figure 5:
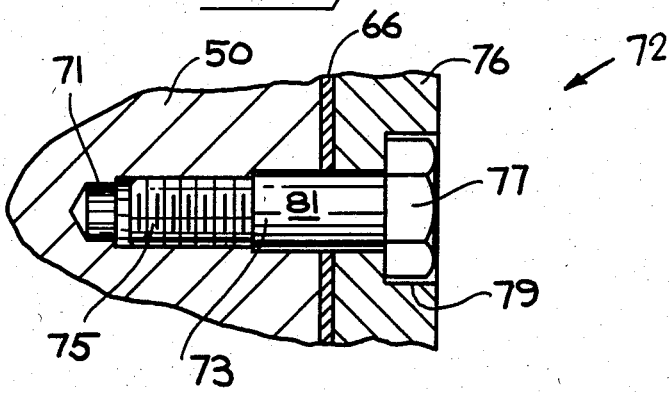
FIG. 5 is a side view of a bolt used to secure the tool in FIGS. 3 and 4.

FIG. 5 shows a special bolt 72 which attaches tool 76 to wheel 50, after passing through the top of wear shoe 66. Wheel 50 has a hole 71 which is threaded near its lower extremity. This hole receives bolt 73 having threads 75 at the inward end. The hole has a depth of approximately ½ inch. The bolt has a head 77 which fits into a recess 79 in tool 76 so that the head is flush or slightly recessed within the tool. Bolt body section 81 is smooth and extends through the tool and into the wheel 50. A slight clearance between the bolt head and the recess allows a socket to drive the bolt. Because of the large forces experienced by the tool, it is important that the bolt heads be recessed within the tool. This type of bolt functions as a dowel, securing and aligning the wheel, wear shoe and tool.

Figure 6:
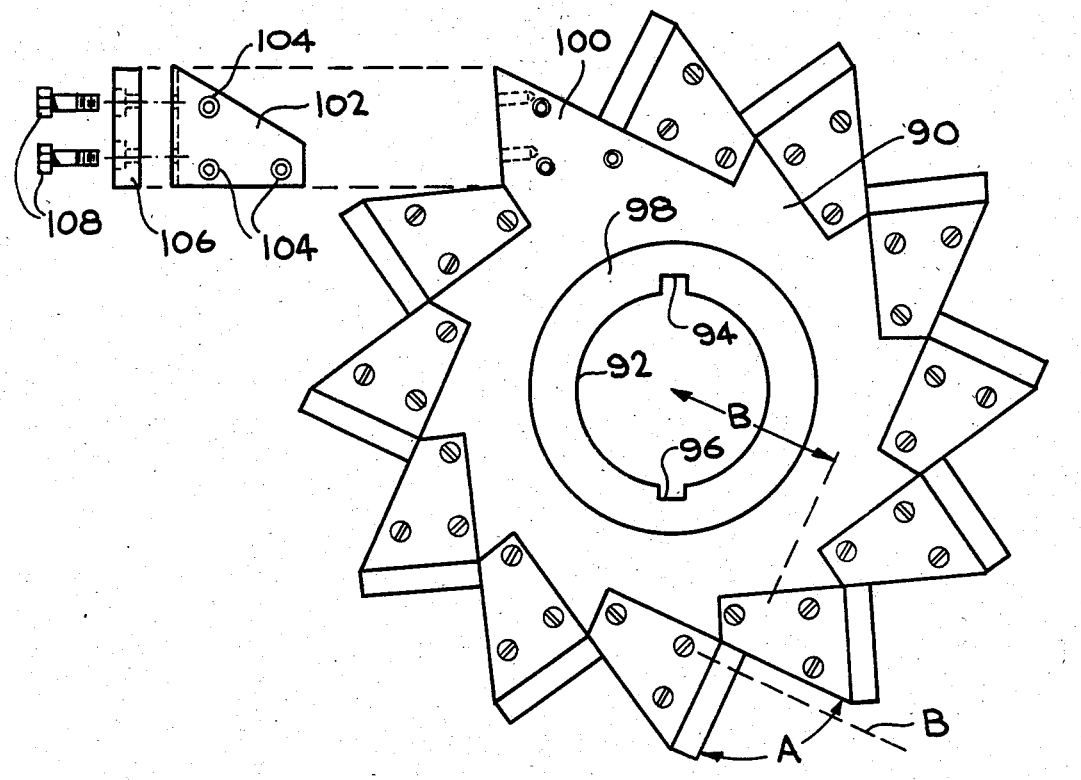
FIG. 6 is a plan view of another of the cutting wheels illustrated in FIG. 1.

With reference to FIG. 6 an upper cutting wheel 90 may be seen having an inside radius 92 and diametrically opposed notches 94 and 96. Once again, the notches are used to index the wheel on keyways of a shaft to prevent slippage. Wheel 90 has a hub portion 98 which is annular, yet an integral part of the wheel. Outer peripheral portions of the wheel are triangular and not piecewise smooth. A typical peripheral triangular region 100 supports a U-shaped wear shoe 102 in a similar manner that wear shoe 66 in FIG. 3 is supported. The wear shoe has holes 104 so that it may be bolted in place to triangular region 100. A tool 106 is fastened by bolts 108. Tool 106 is identical in material to tool 76 in FIG. 3. Similarly wear shoe 102 and wheel 90 are similar in composition to wear shoe 66 and wheel 50 in FIG. 3.

The wheel 90 has a star shape with triangular regions at the periphery of the star. The angle A, between adjacent edges of triangular regions is equal to 90°. The reason for selecting this angle is such that the dashed lines, B, will be at right angles. These lines represent axes of drill bits used to make holes in the triangular regions for the purpose of fastening tools thereto.

Figure 7:
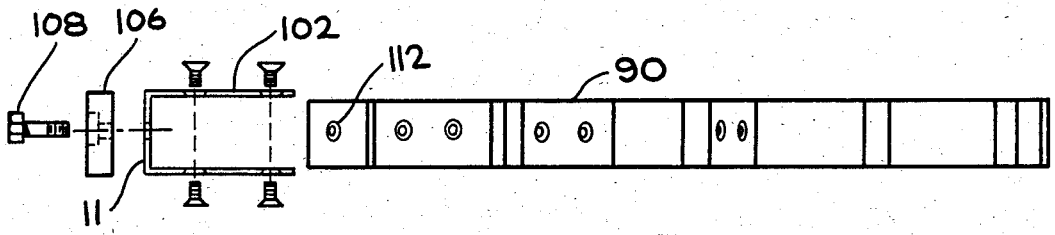
FIG. 7 is a side view of the cutting wheel illustrated in FIG. 6.

FIG. 7 shows that wear shoe 102 has a U-shape with an outward section 110 supporting tool 106. Wear shoe 102 is held in place by bolt 108 which screws into a threaded hole 112 in the outer peripheral region of wheel 90.

Figure 8:
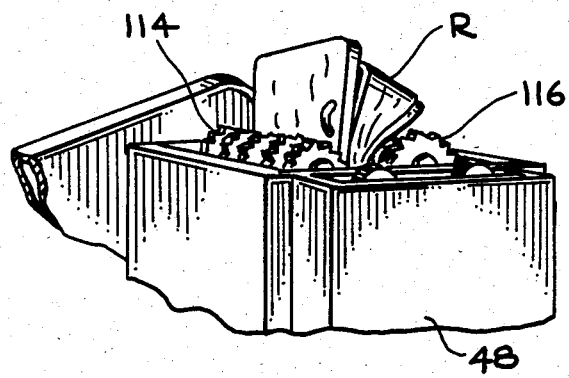
FIG. 8 is a partial perspective view of solid waste being fed into the machine of the present invention.

The upper and lower wheels consist of wheel groups, each group having wheel members spaced at intervals along a central shaft. Members of each group are slightly offset from members of an opposing group so that opposed groups may interleave when brought into close proximity with each other. FIG. 8 shows groups 114 and 116 with a refrigerator R therebetween. The groups 114 and 116 are an upper set of cutting wheels which are ripping the refrigerator in a vertical direction. A cover over the top of the apparatus is not seen. Housing 48 prevents material from being thrown laterally outward.

Figure 9:
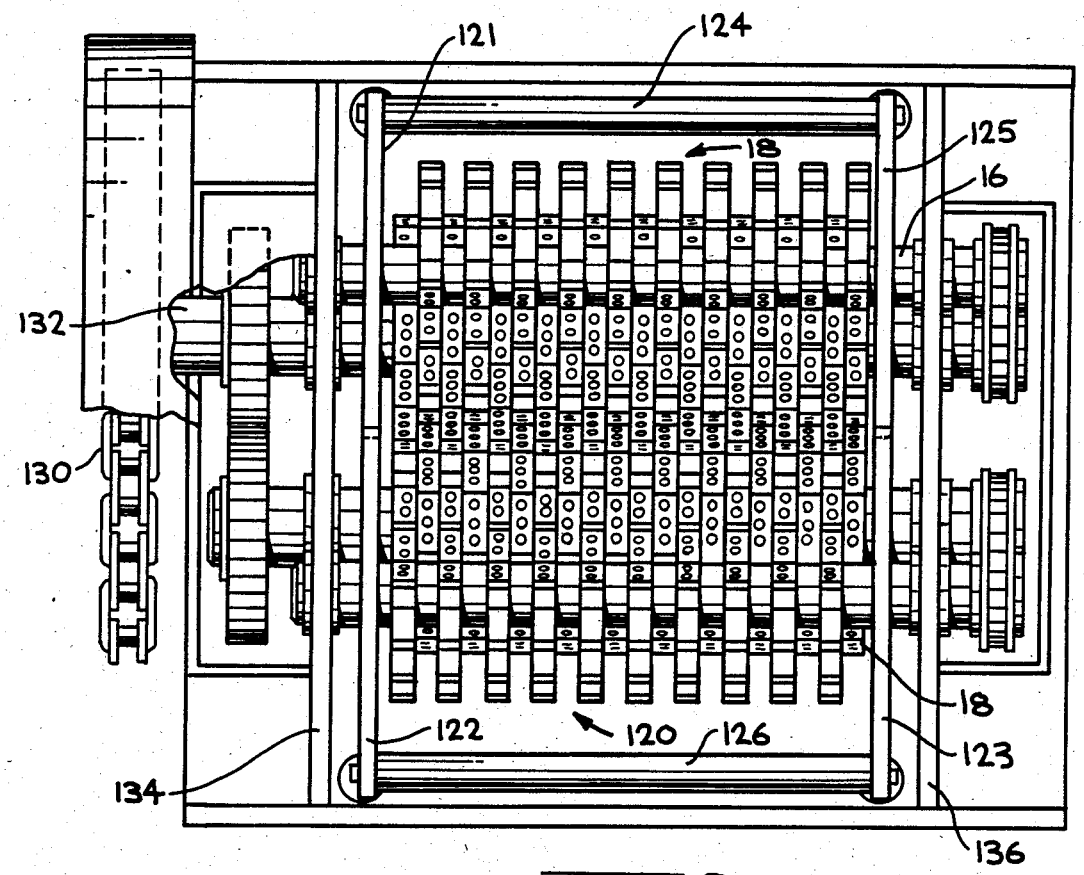
FIG. 9 is a top view of a comminution machine in accord with the present invention.

FIG. 9 illustrates the meshing of the upper wheel sets 118 and 120. The wheel sets may be seen to be supported by arms 121 and 125 on one side of the apparatus and 122 and 123 on the opposite side of the apparatus. Shaft 124 joins arms 121 and 125, while shaft 126 joins arms 122 and 123. These parallel opposed shafts are also parallel to shafts 18 and 16 which carry the upper set of wheels. The interleaving of members of wheel groups, forming the wheel sets, may also be seen. Spacing of interleaving individual wheels is approximately 0.010 to 0.012 inches. Widths may be greater at the hub than for the wheel width. The diameter of each wheel is not critical, but a typical diameter is 30 inches.

Power is provided by means of a motor which transfers rotary energy to a gear, driving chain 130, which in turn drives shaft 132. A gear train connected to shaft 132 transfers power to the various shafts on which the sets of cutting wheels are mounted. Journals mounted in walls 134 and 136 provide support for the shafts on which the lower sets of wheels are mounted. Since the upper shafts are pivoted about the lower shafts, supported by the lever arms, the upper shafts are always a constant distance from the lower shafts.

Figure 10:
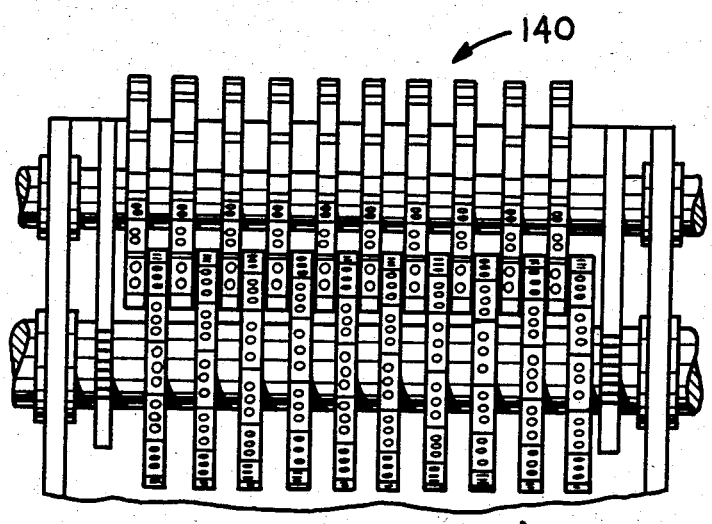
FIG. 10 is a side view of the machine illustrated in FIG. 9, taken along lines 10—10.

FIG. 10 shows the interleaving of an upper set of wheels 140 with a lower set 142. The number of individual wheels is not critical. While ten or twelve wheels are shown on each shaft, the number selected corresponds to the length of each shaft. A shaft length of approximately 7 feet allows large articles such as sofas to be inserted between the first or upper set of wheels.

Figure 11:
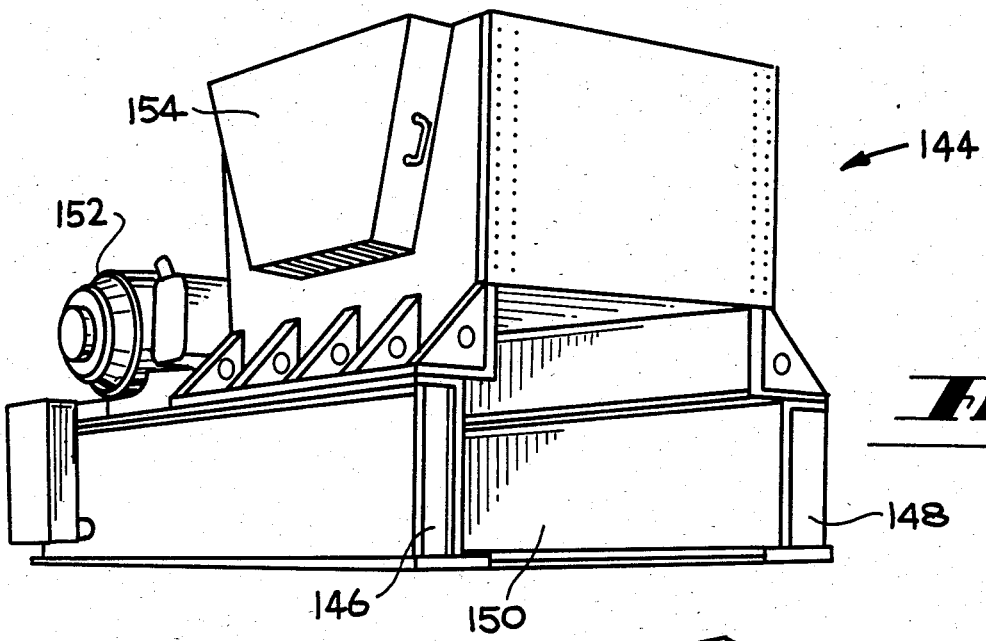
FIG. 11 is a left perspective view of the exterior of the machine illustrated in FIG. 9.
Figure 12:
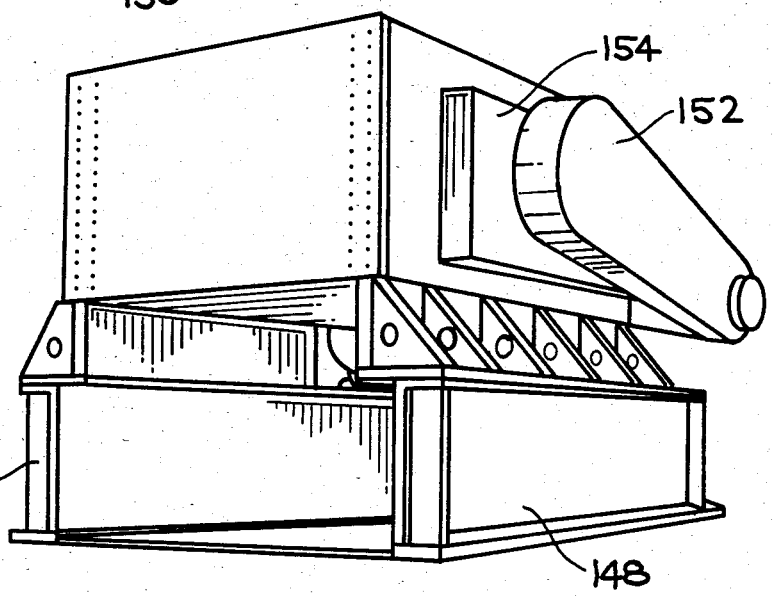
FIG. 12 is a right side perspective view of the machine illustrated in FIG. 11.

FIG. 11 shows an exterior configuration for the apparatus including a housing 144 mounted atop rails 146 and 148. Such rails are spaced apart such than an opening 150 exists therebetween, forming a lower compartment. Containers for removing small chunks of solid waste may be pulled in and out of the lower compartment defined betwen rails. Motive power is provided by a motor 152 at the rear of the apparatus. A cover 154 shields external gears and journals. In FIG. 12, the chain cover 152 may be seen on the right side, transferring power to gears beneath shroud 154.

Figure 13:
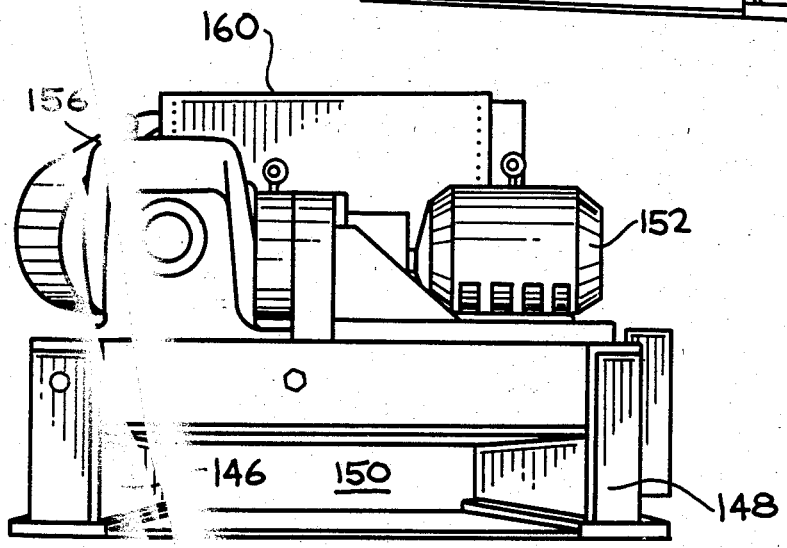
FIG. 13 is a rear view of the machine illustrated in FIG. 11.

The rear view of FIG. 13 shows that motor 152 may be connected to a gear box 156 for appropriate speed reduction. Since the wheels require high torque, typical turning speeds are a few revolutions per minute. A high hoursepower motor is needed to provide sufficient energy to the comminution apparatus. In operation, articles are deposited through the top 160, for comminution through the device, with small pieces falling into the space 150. The apparatus provides efficient cutting and shredding of almost all solid waste, including wood logs, most sheet metal, virtually all fabrics, household articles and most solid industrial waste.

Figure 14:
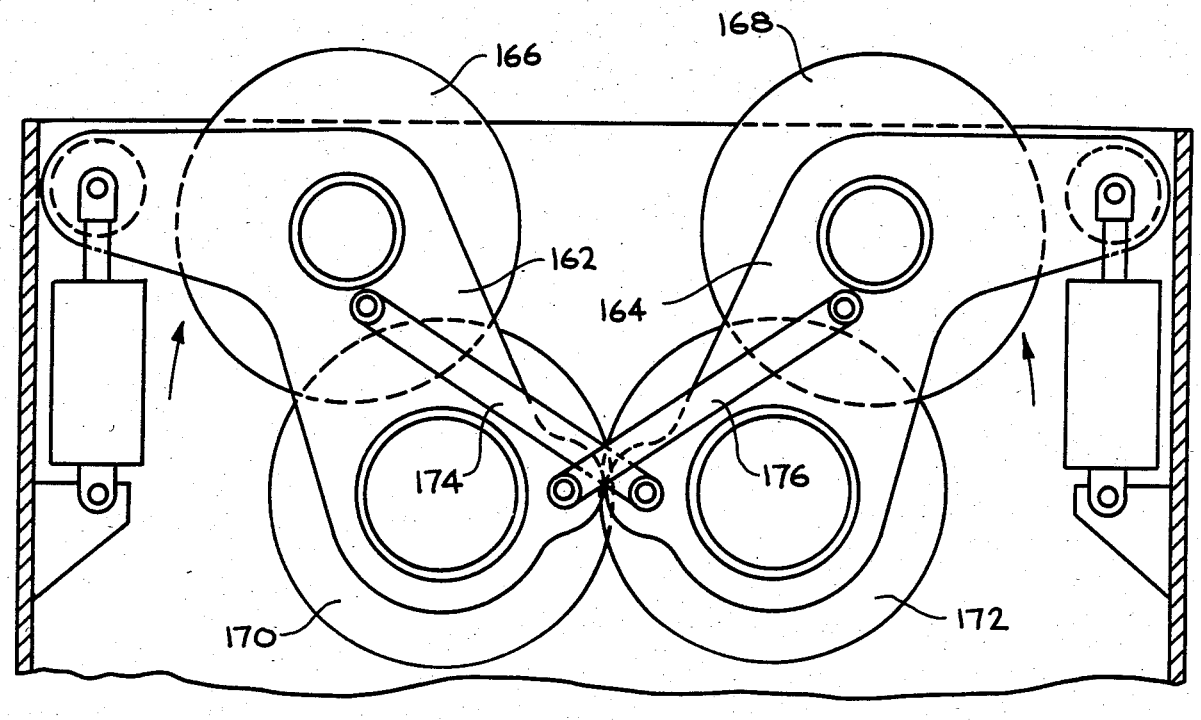
FIGS. 14 and 15 illustrate an alternate joint for synchronizing motion of the machine illustrated in FIG. 1.
Figure 15:
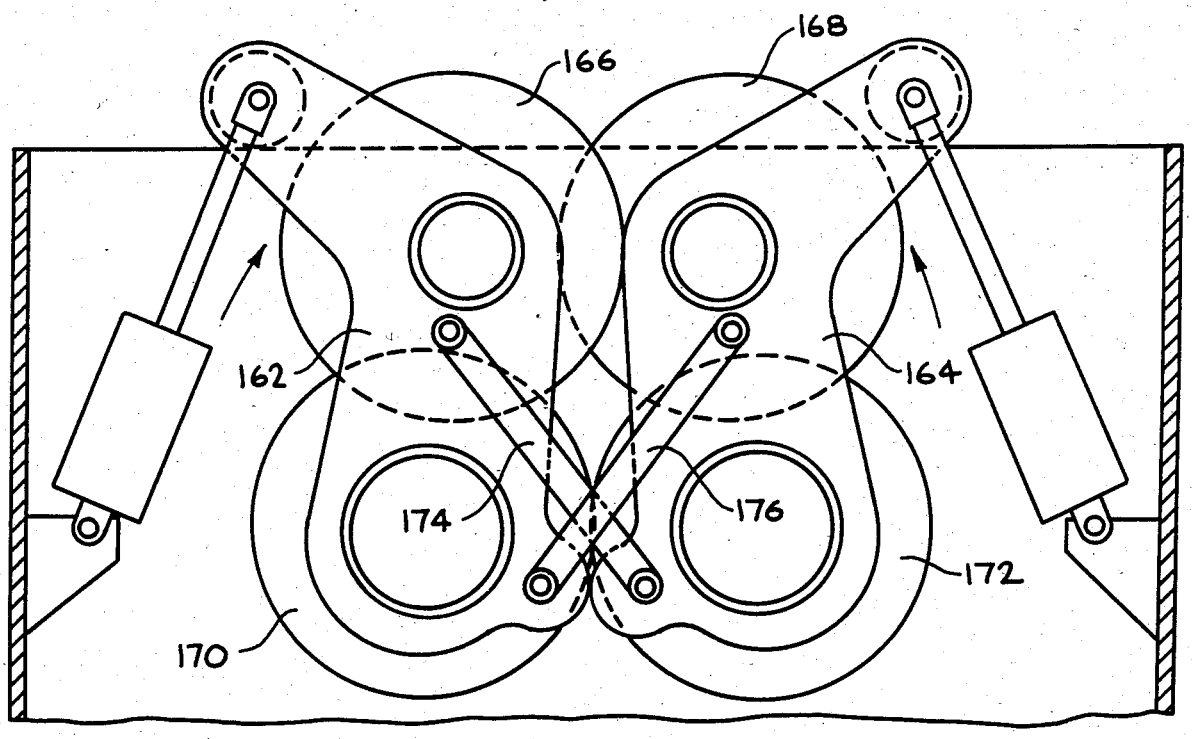

FIGS. 14 and 15 show the upper set of wheels 166 and 168, as well as the lower set of wheels 170 and 172 to be supported on lever arms 162 and 164. In this instance, the joint between lever arms is not formed by meshing gear teeth, but instead is formed by cross connected struts 174 and 176. These struts serve to synchronize motion of the wheel sets.

I claim:

1. A solid waste comminution machine of the type having two sets of interleaving wheels, including a lower set and an upper set of wheel members, each set including a pair of shafts on which the wheel members are mounted, said pairs of shafts mounted on upright, mutually facing, movable arms, the improvement comprising, the upper set of wheel members having ripping and shearing tools attached to the circumferential periphery of the wheel members, the pair of shafts associated with the upper set of wheel members mounted on the movable arms, the lower set of wheel members mounted on a pair of fixed, parallel shafts, said shafts supported at one end of the arms with the lower set of wheel members interleaving in a material shearing relation, the shafts forming a fixed pivot axis for said arms, said arms having fixed lengths with inward and outward ends, the outward ends extending beyond the shafts associated with the upper set of wheels thereby forming leverage regions, and hydraulic piston means having fixed ends and free ends, the free ends connected to said leverage regions for bringing the arms toward each other to a point at which said upper set of wheels mesh with sufficient force to enable ripping of material between said upper set of wheels.

2. The machine of claim 1 wherein said inward ends of said arms are connected at a joint, said joint having means for synchronizing the motion of the arms.

3. The machine of claim 1 wherein said means for synchronizing the motion of the arms comprises gear teeth.

4. The machine of claim 1 wherein said means for synchronizing the motion of the arms comprises struts cross connected to the arms.

5. The machine of claim 1 wherein said upper set of wheel members are sufficiently spaced apart to allow meshing with the lower set of wheel members in positions for cleaning spaces between members of the lower set.

6. The machine of claim 1 wherein said lower set of wheel members is smooth surfaced with members sufficiently spaced apart to allow meshing with the upper set of wheel members in positions for cleaning spaces between members of the upper set.

7. A solid waste comminution machine of the type having a lower set and an upper set of wheel members, the upper set feeding material into the lower set, each set including a pair of shafts on which the wheel members are mounted, said pairs of shafts mounted on upright, mutually facing, movable arms, the improvement comprising, the upper set of wheel members having ripping and shearing tools, the ripping and shearing tools having a cutting edge and being removably attached to the circumferential periphery of the wheel members, the pair of shafts associated with the upper set of wheel members mounted on the movable arms, and the lower set of wheels having a round piecewise smooth, hard rim with the wheels interleaving at closely spaced intervals for shearing material therebetween, the lower set of wheels mounted on parallel shafts the parallel shafts forming a fixed pivot axis for the arms, said arms having inward and outward ends with said inward ends near the pivot axis, the outward ends extending beyond the shafts associated with the upper set of wheels thereby forming leverage regions, and hydraulic piston means connected to said leverage regions for moving the arms together, thereby forcing wheel members of the upper set into a meshing relation with each other with sufficient force to enable material ripping by said upper set.

8. The machine of claim 7 wherein said inward ends of said arms are connected at a joint, said joint having means for synchronizing the motion of the lever arms.

9. A machine for comminuting solid waste comprising, a first set of ripping wheel members mounted on first and second parallel, spaced apart shafts forming first and second cutting wheel groups, said first cutting wheel group having wheel members spaced at intervals along said first shaft, said second cutting wheel group having wheel members spaced at intervals along said second shaft, said wheel members of said first and second cutting wheel groups having cutting and shearing tools with cutting edges, the tools being removably attached to the circumferential periphery of said wheel members, members of each group slightly offset from members of the other group, such that members of opposing groups pass close to each other but do not make contact when said cutting wheels are in a meshing relation with each other, a second set of round shearing wheels mounted on third and fourth parallel, spaced apart shafts forming third and fourth cutting wheel groups, said third cutting wheel group having wheel members spaced at intervals along said third shaft, said fourth cutting wheel group having wheel members spaced at intervals along said fourth shaft, members of each group slightly offset from members of the other group, such that members of opposing groups pass close to each other but do not make contact, first and second pairs of parallel, opposed arms, with inward and outward ends, the first pair of arms supporting the first and third shafts in parallel relation, the second pair of arms supporting the second and fourth shafts in parallel relation, said opposed pairs of arms pivoting near inward ends thereof, where said third and fourth shafts are supported, the outward ends of the arms extending beyond the arm support location of the first and second shafts, thereby forming leverage regions, whereby the spaced relation of sets of cutting wheels may be changed, and hydraulic piston means connected to the leverage regions for increasing and decreasing leverage on said arms whereby said first cutting wheel group can work against said second cutting wheel group with sufficient force to enable ripping by said first set of ripping wheel members.

10. The machine of claim 9 wherein said inward ends of said arms are movably connected at a joint.

11. The machine of claim 10 wherein said joint comprises sections of mutually engaging gear teeth.

12. The machine of claim 10 wherein said joint comprises struts cross connected to said arms.

* * * * *